US006557199B2

(12) United States Patent
Vande Haar

(10) Patent No.: US 6,557,199 B2
(45) Date of Patent: May 6, 2003

(54) WASH SOLUTION MIXING SYSTEM FOR CLOTHES WASHING MACHINE

(75) Inventor: Evan R. Vande Haar, Pella, IA (US)

(73) Assignee: Maytag Corporation, Newton, IA (US)

( * ) Notice: Subject to any disclaimer, the term of this patent is extended or adjusted under 35 U.S.C. 154(b) by 90 days.

(21) Appl. No.: 09/945,612

(22) Filed: Sep. 5, 2001

(65) Prior Publication Data

US 2003/0041388 A1 Mar. 6, 2003

(51) Int. Cl.[7] ..... D06F 33/02
(52) U.S. Cl. ..... 8/158; 8/159; 68/12.12
(58) Field of Search ..... 8/158, 159; 68/12.12

(56) References Cited

U.S. PATENT DOCUMENTS

| | | | | |
|---|---|---|---|---|
| 4,987,627 A | * | 1/1991 | Cur et al. | 8/158 |
| 5,275,026 A | | 1/1994 | Chilcoat | |
| 5,373,714 A | | 12/1994 | Wada | |
| 5,507,053 A | * | 4/1996 | Mueller et al. | 8/158 |
| 5,687,440 A | | 11/1997 | Min et al. | |
| 5,937,677 A | | 8/1999 | Lee | |
| 6,058,743 A | | 5/2000 | Fujii et al. | |
| 6,134,925 A | | 10/2000 | Fujii et al. | |

FOREIGN PATENT DOCUMENTS

| | | |
|---|---|---|
| DE | 3631685 | 3/1988 |
| JP | 2-45093 | 2/1990 |
| JP | 3-9795 | 1/1991 |
| JP | 5-38393 | 2/1993 |
| JP | 5-115677 | 5/1993 |

* cited by examiner

*Primary Examiner*—Philip R. Coe
(74) *Attorney, Agent, or Firm*—Diederiks & Whitelaw, PLC

(57) ABSTRACT

To assure the mixing of detergent into a wash solution during an initial portion of a wash cycle in a clothes washing machine, particularly a horizontal axis or tumble-type washing machine, an additional operational step is employed wherein an inner tub or wash basket of the machine is rotated at a higher than normal speed to create a turbulence for the purpose of mixing and distributing the wash solution. Most preferably, this additional step occurs shortly after the washing machine has been filled with water for a programmed washing operation.

16 Claims, 1 Drawing Sheet

WASH SOLUTION MIXING SYSTEM FOR CLOTHES WASHING MACHINE

BACKGROUND OF THE INVENTION

1. Field of the Invention

The present invention pertains to the art of clothes washing machines and, more particularly, to the incorporation of a wash solution mixing system for a washing machine.

2. Discussion of the Prior Art

A typical clothes washing operation includes the placing of clothes to be laundered within a wash or inner tub which is rotatable within an outer, fixed tub. Thereafter, water and detergent are added into the wash tub to form a cleaning or wash solution. The clothes are then subjected to various wash, drain and rinse cycle portions. The inner tub is provided with a plurality of circumferentially spaced holes such that the cleaning solution is actually retained by the outer tub. The outer tub has associated therewith a port for draining the cleaning solution between consecutive cycle portions through the operation of a pump.

When filling the wash tub, a substantial portion of the detergent is actually directed right into the drain port in order to initially fill the drainage system. Typically, the first 10–15 seconds of fill time simply functions to fill the drain system. If detergent is introduced during this period, that detergent will actually be used to fill the drain system. Even if the introduction of the detergent is delayed, the detergent will tend to sink to this low point. In washing machines that incorporate a recirculation feature, the water and detergent in this drainage zone will still be available for use in the wash cycle. However, in such a washing machine arrangement, either an additional recirculation pump or complicated valving and flow structure must be employed to enable one pump to perform both recirculating and draining operations. That is, a pump would need to be used to reintroduce the detergent in the drainage zone back to the load of clothes being laundered. In washing machines which do not having recirculation features, the detergent concentration in the overall washing solution will be reduced due to a percentage of detergent being lost in the drainage zone.

In order to provide for a more effective overall washing operation by enhancing stain removal performance, it would be desirable to promote the dissolving and distributing of the detergent in the overall wash solution. In any event, there exists a need in the art for a washing machine incorporating a system designed to assure that detergent which has settled in a drainage zone of a washing machine during an initial fill period of a washing operation will be effectively mixed with a remainder of the washing solution in order to assure that sufficient amounts of detergent will be available for an improved wash cycle, instead of being wasted in the drainage zone. There particularly exists a need in the art for a detergent collection arrangement in a horizontal axis washing machine which does not employ a recirculation system.

SUMMARY OF THE INVENTION

The present invention is directed to a system for assuring the mixing of detergent into a wash solution during an initial portion of a wash cycle in a clothes washing machine, particularly a horizontal axis or tumble-type washing machine. In accordance with a preferred embodiment of the invention, an additional step is employed in the wash cycle wherein the inner tub or wash basket is rotated or tumbled at a higher speed for the purpose of mixing and distributing the wash solution. Most preferably, this additional step occurs shortly after the washing machine has been filled with water for a programmed washing operation.

In accordance with the invention, the time and tumble speed associated with this additional step is established to provide sufficient mixing, while avoiding the development of excessive suds. In accordance with the most preferred embodiment, the wash basket is tumbled in the order of 70 RPM for approximately 9 seconds at about 3 minutes after the fill portion of the wash cycle is completed. In any event, additional objects, features and advantages of the present invention will become more readily apparent from the following detailed description of a preferred embodiment when taken in conjunction with the drawing.

DETAILED DESCRIPTION OF THE PREFERRED EMBODIMENT

Figure 1:
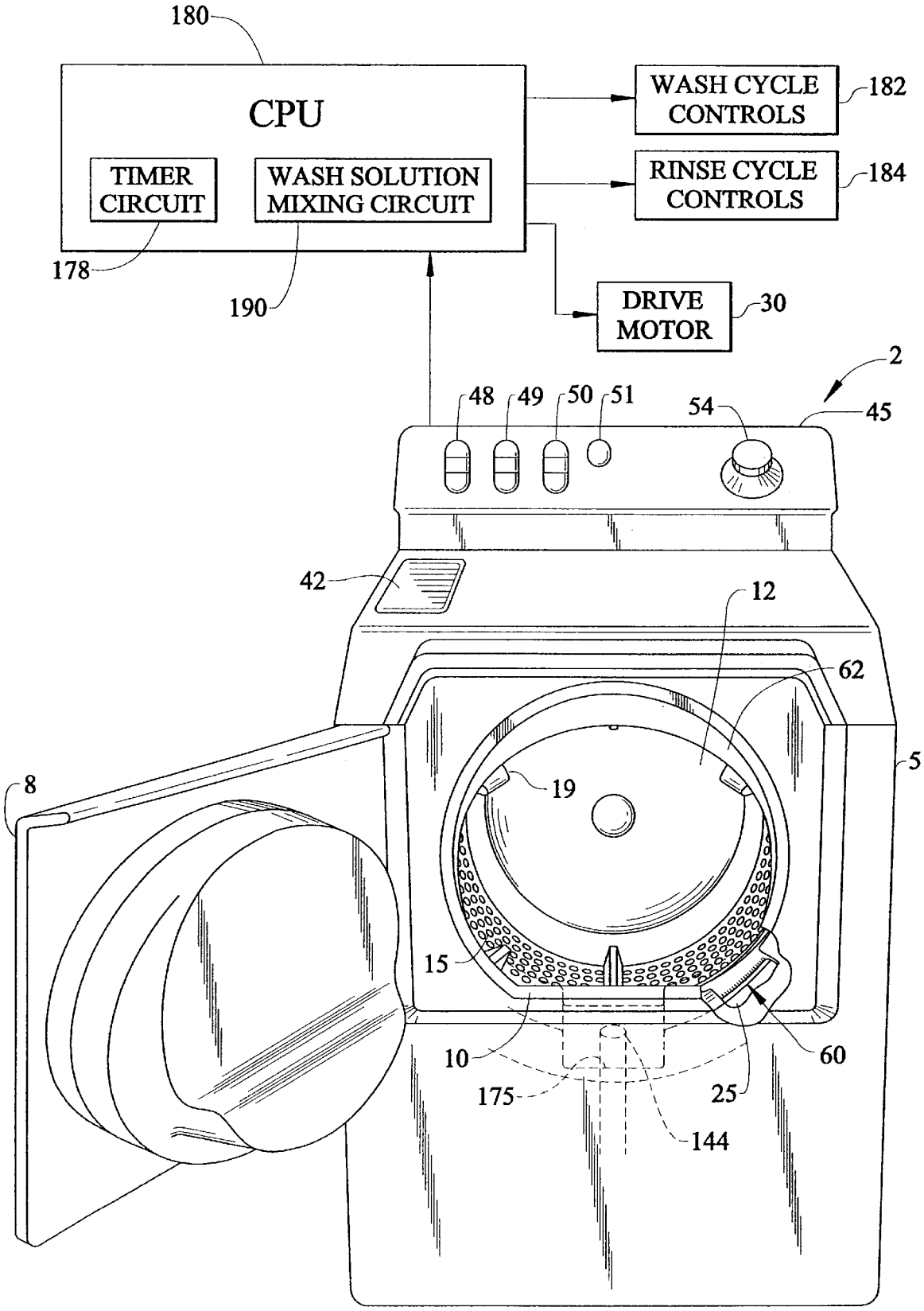
FIG. 1 is a perspective view of a horizontal axis washing machine incorporating the wash solution mixing system of the invention.

With initial reference to FIG. 1, an automatic horizontal axis washing machine incorporating the control system of the present invention is generally indicated at 2. In a manner known in the art, washing machine 2 is adapted to be front loaded with articles of clothing to be laundered through a tumble-type washing operation. As shown, automatic washing machine 2 incorporates an outer cabinet shell 5 provided with a front door 8 adapted to extend across an access opening 10. Front door 8 can be selectively pivoted to provide access to an inner tub or spinner 12 that constitutes a washing basket within which the articles of clothing are laundered.

As is known in the art, inner tub 12 is formed with a plurality of holes 15 and multiple, radially inwardly projecting fins or blades 19 are fixedly secured to inner tub 12. Inner tub 12 is mounted for rotation within an outer tub 25, which is supported through a suspension mechanism (not shown) within cabinet shell 5. Inner tub 12 is mounted within cabinet shell 5 for rotation about a generally horizontal axis. Actually, the rotational axis is angled slightly downwardly and rearwardly. A motor, which is represented at 30 and preferably constituted by a variable speed, reversible electric motor, is mounted within cabinet shell 5 and adapted to drive inner tub 12. More specifically, inner tub 12 is rotated during both wash and rinse cycles such that articles of clothing placed therein actually tumble through either water, water/detergent or another washing medium supplied within inner tub 12. Given that inner tub 12 is provided with at least the plurality of holes 15, the water or water/detergent can flow between the inner and outer tubs 12 and 25.

Automatic washing machine 2 is also shown to include an upper cover 42 that provides access to an area for adding detergent, softeners and the like. In addition, an upper control panel 45, including various selector buttons 48–51 and a control knob 54, is provided for manually establishing a desired washing operation in a manner known in the art. At this point, it should be noted that washing machine 2 can equally utilize other arrangements for the input of desired washing operation parameters, such as a touch screen display as disclosed in pending U.S. patent application Ser. No. 09/741,067 entitled "Interactive Control System for a Laundry Appliance" filed Dec. 21, 2000, the disclosure of which is incorporated herein by reference.

In order to allow inner tub 12 to freely rotate within outer tub 25 during a given washing operation, inner tub 12 is spaced concentrically within outer tub 25. This spacing establishes an annular gap (not labeled) between the inner and outer tubs 12 and 25. A flexible sealing device, generally indicated at 60 in FIG. 1, functions to bridge this gap between inner and outer tubs 12 and 25 to prevent objects from flowing into the outer tub 25. Further provided as part of washing machine 2 in a manner known in the art is a sealing boot 62 which extends generally between outer tub 25 and a frontal panel portion (not separately labeled) of cabinet shell 5. Finally, as also known in the art, outer tub 25 is provided with a drain port 144 located in a lower rear portion of a sump 175 integrally formed as part of outer tub 25.

During a normal washing operation, automatic washing machine 2 will proceed through a main wash cycle and a predetermined number of rinse cycles. In the main wash cycle, a preset amount of water is added to any detergent, or other washing solution supplied in the areas beneath cover 42, and inner tub or spinner 12 is driven to tumble articles of clothing through the resulting solution, with inner tub rotating at approximately 50 RPM. In automatic washing machine 2, the tumbling period is determined by a timer circuit 178 incorporated within a CPU 180 which, in turn, signals wash and rinse cycle controls 182 and 184. Periodically, it is preferable to alter the rotational direction of inner tub 12 during this period to vary the tumbling pattern through inner tub or wash basket drive motor 30. As will be discussed more fully below, CPU 180 incorporates a wash solution mixing circuit generally indicated at 190.

After the wash cycle tumbling time period has elapsed, a drain cycle is initiated with a continued tumbling action. In the preferred embodiment, this tumble drain period lasts approximately sixty seconds. Following the tumble drain, inner tub 12 is subjected to a spin mode wherein inner tub 12 spins at approximately 100 RPM for approximately two minutes. At this point, the water/detergent solution has been substantially removed from within inner tub 12, although the articles of clothing will certainly still possess a certain percentage of the solution. Next, the articles of clothing are subjected to the predetermined number of rinse cycles wherein inner tub 12 is filled to a predetermined level with water and placed in a rinse cycle tumble pattern. In the most preferred form, three rinse cycles are provided. In general, each of the rinse cycles sequentially incorporates a rinsing tumble mode, followed by a tumble drain, a pause drain and then a rinse cycle spin mode. Thereafter, a final draining occurs and inner tub 12 is allowed to coast to a stop position and the washing operation is completed. This basic operation of washing machine 2 is known in the art and has been described both for the sake of completeness and to establish the need and advantages of the system of the present invention. Further details of this overall operational sequence is described in commonly assigned U.S. Pat. No. 6,241,782 entitled "Horizontal Axis Washing Machine Incorporating Flush Tumble Cycle" issued Jun. 5, 2001, which is hereby incorporated by reference.

Since a prior operation of washing machine 2 would terminate in a final drain cycle, the drain system of washing machine 2 is essentially empty. Therefore, upon initiating a new cycle, the introduced washing medium or solution which, for purposes of this discussion, will be constituted by a combination of water and detergent, will actually flow through inner tub 12 and toward drain port 144. Of course, a percentage of the washing medium will be retained by the articles of clothing placed in inner tub 12 for laundering. For instance, the first 10–15 seconds of the fill portion of the wash cycle will essentially function to fill the drain system, including drain port 144. Due to the arrangement of the various components of washing machine 2, the initial fill fluid mainly comes down outer tub 25 at a rear portion thereof. Due to this arrangement, a fair percentage of the overall detergent added into washing machine 2 will settle or be initially collected down in the area of sump 175.

In accordance with the present invention, it is desired to assure that this detergent be mixed and distributed in the wash solution. To this end, an additional step is preferably added to the wash cycle. More specifically, soon after washing machine 2 has completed the initial water fill portion of the wash cycle, CPU 180, through wash solution mixing circuit 190, causes drive motor 30 to rotate inner tub 12 at a higher speed than that for a normal wash cycle in order to create a turbulence in the wash solution by which a better mixture of the washing solution is attained. The time and speed for this step is established to provide sufficient mixing, while avoiding the development of excessive suds. In accordance with the most preferred form of the invention, inner tub 12 is tumbled in the order of 70 RPM for approximately 9 seconds at about 3 minutes after the fill portion of the wash cycle is completed. However, the actual tumble speed, duration and timing of this step could vary. In any event, it has been found that operating washing machine 2 in this fashion enhances the dissolving and/or distribution of the detergent in the overall wash solution, thereby improving the stain removal performance of washing machine 2.

Although the mixing system of the invention can be incorporated in washing machine 2 by itself in order to enhance the wash solution, a detergent collection tray (not shown) can also be advantageously provided within sump 175 to collect the detergent prior to reaching drain port 144. The use of such a detergent collection tray arrangement is disclosed in co-assigned U.S. Patent Application entitled "Washing Machine Incorporating Detergent Tray" filed on even date herewith and incorporated herein by reference. In any event, although described with reference to a preferred embodiment of the invention, it should be readily understood that various changes and/or modifications can be made to the invention without departing from the spirit thereof. For instance, although the present invention is considered particularly advantageous when utilized in a horizontal axis or tumble-type washing machine, the invention could also be employed in a more conventional vertical axis washing machine. Regardless, the invention is only intended to be limited by the scope of the following claims.

I claim:

1. A clothes washing machine comprising:

a cabinet shell including a door;

an outer tub mounted within the cabinet shell;

an inner tub mounted within the outer tub, said inner tub being adapted to receive articles of clothing to be laundered and a wash solution, including a combination of water and detergent, during a washing operation incorporating a wash cycle and at least one rinse cycle; and means for rotating the inner tub within the outer tub at a first rate, in order to mix a settled portion of the detergent into the wash solution, followed by a second rate, which is lower than the first rate, in the wash cycle.

2. The clothes washing machine according to claim 1, wherein the rotating means functions to tumble the articles of clothing through the wash solution during the wash cycle.

3. The clothes washing machine according to claim 1, wherein the rotating means establishes the first rate following completion of a water fill portion of the washing operation.

4. The clothes washing machine according to claim 3, wherein the rotating means establishes the first rate minutes after completion of the water fill portion of the washing operation.

5. The clothes washing machine according to claim 4, wherein the rotating means establishes the first rate approximately three minutes after completion of the water fill portion of the washing operation.

6. The clothes washing machine according to claim 1, wherein the rotating means establishes the first rate minutes into the washing operation.

7. The clothes washing machine according to claim 1, wherein the first rate is approximately 70 rpm.

8. The clothes washing machine according to claim 1, wherein the first rate is maintained for approximately nine seconds.

9. A method of performing a washing operation, including a wash cycle and at least one rinse cycle, on articles of clothing within a washing machine including an inner tub which is rotatably mounted within an outer tub comprising:

loading the inner tub with articles of clothing to be washed;

performing a fill operation by introducing both water and a detergent, which are adapted to form a wash solution, into the washing machine;

rotating the inner tub at a first rate in order to mix a settled portion of the detergent with the water; and reducing a rotational speed of the inner tub to a second rate, which is lower than the first rate, in the wash cycle.

10. The method of claim 9, wherein rotation of the inner tub causes the articles of clothing to tumble through the wash solution during the wash cycle.

11. The method of claim 9, further comprising: establishing the first rate following completion of a water fill portion of the washing operation.

12. The method of claim 11, wherein the first rate is established minutes after completion of the water fill portion of the washing operation.

13. The method of claim 12, wherein the first rate is established approximately three minutes after completion of the water fill portion of the washing operation.

14. The method of claim 9, further comprising: establishing the first rate minutes into the washing operation.

15. The method of claim 9, wherein the first rate is approximately 70 rpm.

16. The method of claim 9, further comprising: maintaining the first rate for approximately nine seconds.

* * * * *